US005941640A

United States Patent [19]

Thatcher

[11] Patent Number: 5,941,640

[45] Date of Patent: Aug. 24, 1999

[54] ROLL TOP BLADDER

[75] Inventor: Bryce Thatcher, Rexburg, Id.

[73] Assignee: Ultimate Direction, Inc., Rexburg, Id.

[21] Appl. No.: 08/911,180

[22] Filed: Aug. 14, 1997

[51] Int. Cl.[6] ..... B65D 33/14

[52] U.S. Cl. ..... 383/22; 383/30; 383/43; 383/61; 383/90

[58] Field of Search ..... 383/22, 31, 30, 383/82, 83, 85, 88, 89, 90, 901, 43, 61

[56] References Cited

U.S. PATENT DOCUMENTS

| | | | |
|---|---|---|---|
| 601,421 | 3/1898 | Augustin | 383/901 X |
| 747,634 | 12/1903 | Peterson | 383/901 X |
| 1,183,962 | 5/1916 | Eggers | 383/90 X |
| 1,317,102 | 9/1919 | Reid | 383/901 X |
| 1,652,457 | 12/1927 | Reach | 383/901 X |
| 2,041,515 | 5/1936 | Richards . | |
| 2,355,786 | 8/1944 | Dreher et al. | 383/90 |
| 2,356,602 | 8/1944 | Madsen | 383/90 |
| 2,798,522 | 7/1957 | Hurt | 383/90 X |
| 2,918,282 | 12/1959 | Waterval | 383/90 X |
| 3,251,390 | 5/1966 | Evans | 383/31 X |
| 3,289,723 | 12/1966 | Clark | 383/85 X |
| 3,367,380 | 2/1968 | Dickey | 383/43 X |
| 3,437,117 | 4/1969 | Vitello et al. | 383/43 X |
| 3,815,794 | 6/1974 | Carlisle | 383/43 X |
| 4,420,097 | 12/1983 | Motsenbocker . | |
| 4,815,893 | 3/1989 | Feder . | |
| 4,905,298 | 2/1990 | Walor | 383/61 X |
| 5,060,833 | 10/1991 | Edison et al. . | |

*Primary Examiner*—Jes F. Pascua

*Attorney, Agent, or Firm*—Morriss, Bateman, O'Bryant & Compagni

[57] ABSTRACT

The bladder includes two sidewall portions which are disposed opposite one another. Along a majority of the perimeter, the first and second sidewalls are joined together so as to form a body defining a containment area which is substantially enclosed by the sidewalls. One portion of each of the two sidewalls is not joined with the opposing sidewall so as to form a bladder with an opening along one portion thereof. In accordance with one aspect of the invention, the sidewalls of the bladder form a body, and a neck which extends beyond the unattached portions of the sidewalls. An opening is formed in a neck which extends from the body. The neck is open at opposing ends to thereby provide a conduit for placing fluids into the containment area of the body. To close the conduit formed by the neck portion, the neck portion is rolled toward the body. The rolled neck portion seals the opening closed and prevents liquid in the containment area from escaping out of the neck.

19 Claims, 3 Drawing Sheets

ROLL TOP BLADDER

BACKGROUND OF THE INVENTION

1. Field of the Invention

The present invention relates to a roll top bladder for use in sports. More specifically, the present invention relates to a bladder which is configured for holding in a backpack or sport pack which holds liquids for consumption during sporting activities while providing a unique method for accessing the interior of the bladder.

2. State of the Art

In recent years there has been a tremendous increase in the popularity of many outdoor sporting activities such as bicycling (on-road or mountain biking), hiking, rock climbing, etc. Most of these activities are conducted in somewhat remote areas or under conditions in which it is inconvenient for the participant to stop and drink from a conventional water source such as a drinking fountain or a cup.

Because of the growth in such activities and the need for liquids during strenuous exercise, there has been a significant increase in the use of liquid supply bladders. The bladders typically consist of a flexible container which will hold one or more liters of liquid. In many currently popular versions, the bladder will be connected to an elongate tube with has a closure valve formed therealong. The elongate tube is provided so that the bladder may be placed in a backpack or sport pack worn by the user and the liquid contents thereof accessed at will. The bladder either may be filled by pouring liquid into the elongate tube, or the bladder may be provided with a separate valve which allows liquids to be poured into the bladder.

Such bladders, however, have several problems. First, it is often desirable to fill a container, including a bladder, at least partially with ice before use. The ice maintains the liquid contents of the bladder cool and provides additional liquid as it melts. Unfortunately, many of the configurations currently available are not configured to receive large pieces of ice. Rather, the user must often fill the bladder and then place of the bladder in a freezer, etc. Of course, the repeated freezing and thawing of the bladder can cause premature degradation of the material. Additionally, considerable time is necessary to create sufficient ice within the bladder to keep the contents thereof cool for an extended period in hot weather.

A second and potentially more serious problem with the bladders is that they are relatively difficult to dry out and to clean. While soap and water can be flushed through the bladder, a bladder must be dried out to prevent the growth of undesirable bacteria or mold spores. Additionally, if the bladder is used for drinks containing milk products or other liquids which may promote mold or bacteria grow, it is preferable to scrub the bladder. The small inlet and outlet holes of the devices of the prior art make it extremely difficult to scrub the interior of the bladder to properly remove the mold or bacterial growth. Thus, bladders are often replaced once the mold or bacterial growth becomes noticeable.

Thus, there is a need for an improved bladder which provides increased access to the inner containment area of the bladder. Such an improved bladder should securely hold liquids, should be easy to use, easy to dry after use, and should be easy to clean should cleaning be necessary.

SUMMARY OF THE INVENTION

Thus, it is an object of the present invention to provide an improved bladder which increases access to the containment are of the bladder while holding liquids securely.

It is another object of the present invention to provide an opening in the bladder which is sufficient to enable rapid drying of the interior of the containment area of the bladder to thereby decrease the growth of mold or bacteria within the bladder.

It is another object of the present invention to provide such a bladder which permits the placement of ice and other objects in the containment area.

It is still another object of the present invention to provide such bladder which is easy to use and inexpensive to manufacture.

The above and other objects of the invention are realized in specific illustrated embodiments of a roll top bladder for holding liquids. The bladder includes two sidewall portions which are disposed opposite one another. Along a majority of the perimeter, the first and second sidewalls are joined together so as to form a body defining a containment area which is substantially enclosed by the sidewalls. One portion of each of the two sidewalls is not joined with the opposing sidewall so as to form a bladder with an opening along one portion thereof.

In accordance with one aspect of the invention, the sidewalls of the bladder form a body, and a narrowed neck which extends beyond the unattached portions of the sidewalls. An opening is formed in a neck which extends from the body. The neck is open at opposing ends to thereby provide a conduit for placing fluids into the containment area of the body. To close the conduit formed by the neck portion, the neck portion is rolled or folded toward the body. The rolled neck portion seals the opening closed and prevents liquid in the containment area from escaping out of the neck.

In accordance with other aspects of the present invention, the bladder is made from a material having high self-friction, such as polyurethane or static cling vinyl. The high self-friction material causes the opposing sidewalls to stick together unless fluid is disposed therebetween and helps to seal the neck portion when it is rolled closed.

In accordance with still another aspect of the present invention, a holding mechanism is disposed on the neck portion to prevent the neck portion from unrolling in the event that fluid pressure is applied from the containment area back toward the neck portion.

In accordance with still yet another aspect of the present invention, a support frame is attached to the bladder to enable hanging of the bladder from a tree or similar structure.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
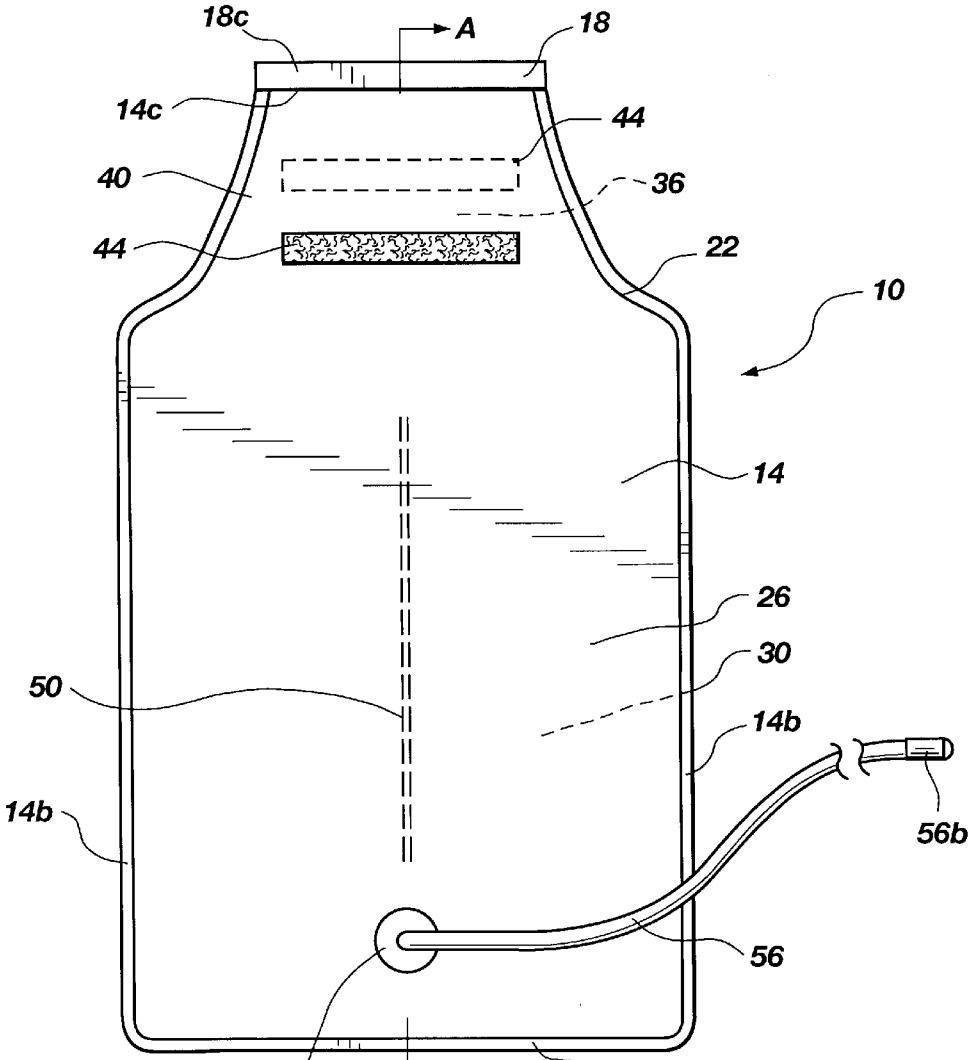
FIG. 1 shows a front view of a roll top bladder made in accordance with the principles of the present invention.

Referring to FIG. 1, there is shown a front view of a roll top bladder, generally indicated at 10. The bladder 10 is formed by a first sheet 14 and a second sheet 18 (only the top end of which is shown) of pliant material such as plastic. For reasons which will be discussed in greater detail below, it is preferable that the sheets be made from material which has a high degree of self-friction. In other words, it is desirable that the two sheets 14 and 18 tend to engage one another. For this purpose, it has been found that using a polyurethane or other plastic having similar characteristics achieves the desired result.

The first and second sheets 14 and 18, respectively, are bonded to one another about their perimeter, as indicated at 22. The bonding may be done by use of adhesive, an ultrasonic welder, a heat sealer, or any other commercially practicable method.

As shown in FIG. 1, the bonding 22 about the perimeter of the first and second sheets, 14 and 18, extends around a bottom side and lateral sides (shown as 14*a* and 14*b* respectively) of the sheets so that the two sheets form the body 26 of the bladder 10. The body 26 of the bladder 10 defines a containment area 26 sufficiently large to hold a supply of liquid. Typically, the containment area is designed to hold between about 1 and 2 liters.

Unlike the bottom and lateral sides 14*a* and 14*b*, the top side of the first and second sheets 14 and 18 are left unbonded. In other words, the top side 14*c* of the first sheet 14 and the top side 18*c* of the second sheet 18 are not attached to each other and form an opening 36 into to body 26 of the bladder 10. As shown in FIG. 1, this opening forms an elongate channel in a tapered neck 40 formed by the first and second sheets 14 and 18. While the opening 36 can be as small as approximately an inch in length, it is preferable for the opening to be at least one-third of the width of the bladder 10, and more preferably about one-half the width of the bag as measured from opposing lateral sides.

The opening in the top end of the bladder 10 has several significant advantages over the bladders which are currently being used. First, because the opening in the top side of the bladder 10 is much larger than the valves or stops used in other bladders, it is much easier to fill the bladder with liquids, such as water, and solids, such as ice. While many bladders currently sold require the bladder to be filled and placed in a freezer overnight to ensure that the liquid in the bladder remains cold when the bladder is used in hot climates such as mountain biking or other outdoor activities. The repeated freezing and thawing is harmful to the bladder, and such a method of keeping the liquid cool prohibits spontaneous usage of the bladder if chilled liquid is desired.

In contrast, the larger opening in the present invention allows the user to fill the bladder more rapidly with liquid. Additionally, the opening enables the user to fill the bladder at least partially with ice immediately before usage.

Another benefit to the large opening provided by the configuration shown in FIG. 1 is that the opening enables the containment area 30 of the body 26 of the bladder 10 to dry much more rapidly than is possible through the small valves or plugs of the competing bladders. Instead of allowing mold and/or bacteria to grow in the damp bladder, the configuration of the present invention enables the entire bladder to be dried out in a relatively short period of time—thereby minimizing risk of bacteria or mold growing in the bladder.

Still another advantage of the large opening formed by the opening 36 between the first and second sheets 14 and 18 is that the interior of the bladder 10 is accessible to scrubbing sponges and the like which can be used to throughly clean the containment area 30. Thus, for example, if a person were to fill the bladder 10 with a milk based drink and some were to sour, the user could easily scrub the interior of the bladder with soap and water to remove any residue of milk fat, etc., which might serve as a medium for bacterial growth.

In order to close the opening 36, the top ends 14*c* and 18*c* of each sheet, 14 and 18, respectively, are rolled or folded toward the body 26 of the bladder 10. As the two sheets roll together, they form a seal through which liquid will not escape. Using a polyurethane or static cling vinyl is preferred because the two sheets 14 and 18 develop frictional force there between and provide a seal which resists the flow of liquid through toward the open ends.

A pair of hook and loop fasteners 44 are provided to hold the neck 40 in a rolled/folded orientation and thereby prevent liquid from passing through the neck and out the nonbonded first and second ends 14*c* and 18*c*. Those skilled in the art will appreciate that other holding mechanism can be used to maintain the neck 40 in the rolled/folded position.

Also shown in FIG. 1 is a baffle 50. The baffle 50 is disposed in the middle of the containment area 30 and runs generally vertically. The baffle 50 is used to prevent excess lateral movement of liquid stored in the containment area when the bladder 10 is used during cycling or other sports. While multiple bladders can be used, a single bladder will generally limit lateral movement of the liquid sufficiently to prevent displacement of the bladder on the user's back.

FIG. 1 also shows a drinking tube 56. The drinking tube 56 is attached at a first end 56*a* to the body 26 of the bladder, and is disposed in fluid communication with the containment area 30. An opposing second end 56*b* of the drinking tube 56 typically will have a valve 60 by which the user can control the flow of liquid through the drinking tube.

Figure 2:
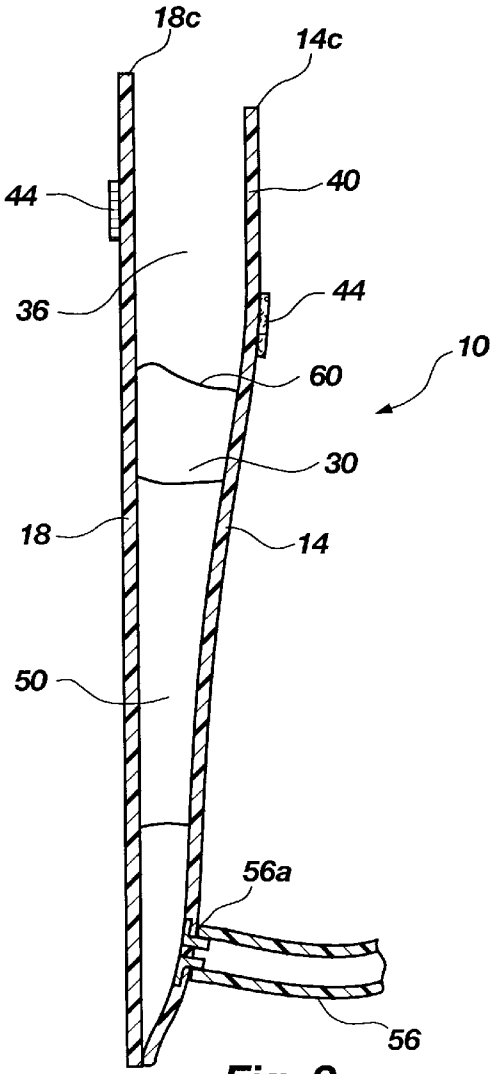
FIG. 2 shows a side cross-sectional view of the roll top bladder of FIG. 1.

Turning now to FIG. 2, there is shown a side cross-sectional view of the bladder 10. The bladder 10 is filled with a liquid 50, such as water. Because of the large opening 36 formed in the neck 40, the containment area 30 can be filled quickly. Additionally, the opening 36 formed between the first and second sheets 14 and 18 in the neck 40, is sufficiently large for filling the bladder 10 with ice cubes and for inserting a cleaning brush, etc., into the containment area.

As the bladder 10 is filled with the liquid 60, the sidewalls formed by the first and second sheets 14 and 18 are pushed apart. However, the liquid 50 will generally not extend up into the neck 40. Thus, top ends 14*c* and 18*c* can be pressed together and rolled to form a seal. If a polyurethane, static cling vinyl, or some like material, is used, a good seal if formed. Furthermore, the hook and loop fasteners 44 are attached to one another to prevent the rolled neck portion 40 from unrolling in the event of a sudden pressure on the bladder 10.

Figure 3:
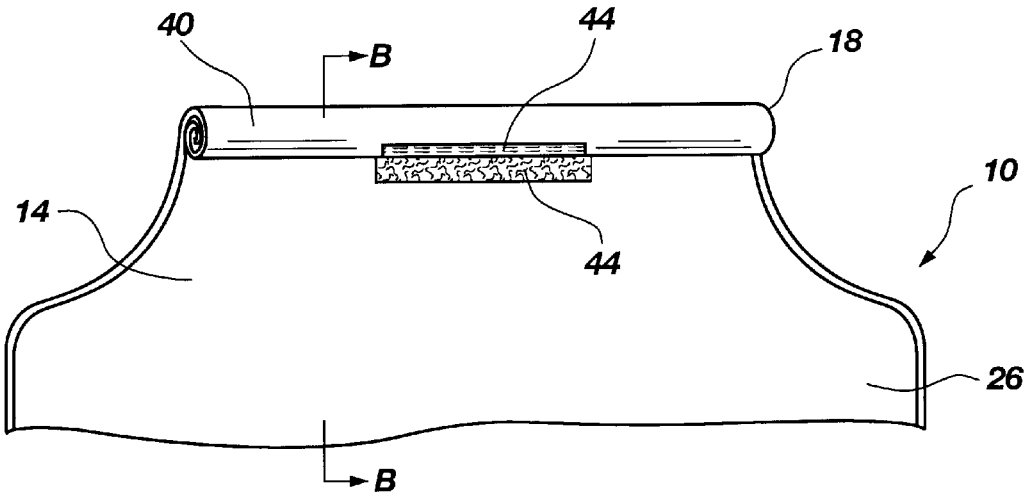
FIG. 3 shows a fragmented view of the roll top bladder of FIG. 1, with the neck rolled to close the containment area of the bladder.

In FIG. 3, there is shown a fragmented view of the bladder 10. The neck portion 40 is rolled toward the body 26 a sufficient distance that the hook and loop fasteners 44 engage one another and thereby hold the neck portion in a rolled configuration. The portion of the first and second sheets 14 and 18 which form neck portion 40 engage one another and form a seal adjacent the top of the body 26.

Figure 4:
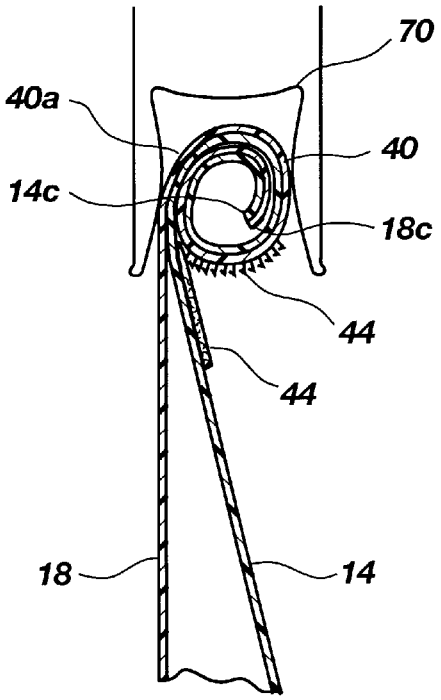
FIG. 4 shows a side cross-sectional view of the roll top bladder of FIG. 3.

FIG. 4 shows a cross-sectional view of FIG. 3 taken along the line B—B. This view shows the rolled neck portion 40 which forms a seal between the top end of the first and second sheets 14*c* and 18*c*. The roll 40*a* is held in place by the hook and loop fasteners. Of course, other mechanisms, such as a clip 70, could be used to prevent the rolled neck portion 40 from unrolling.

Figure 5:
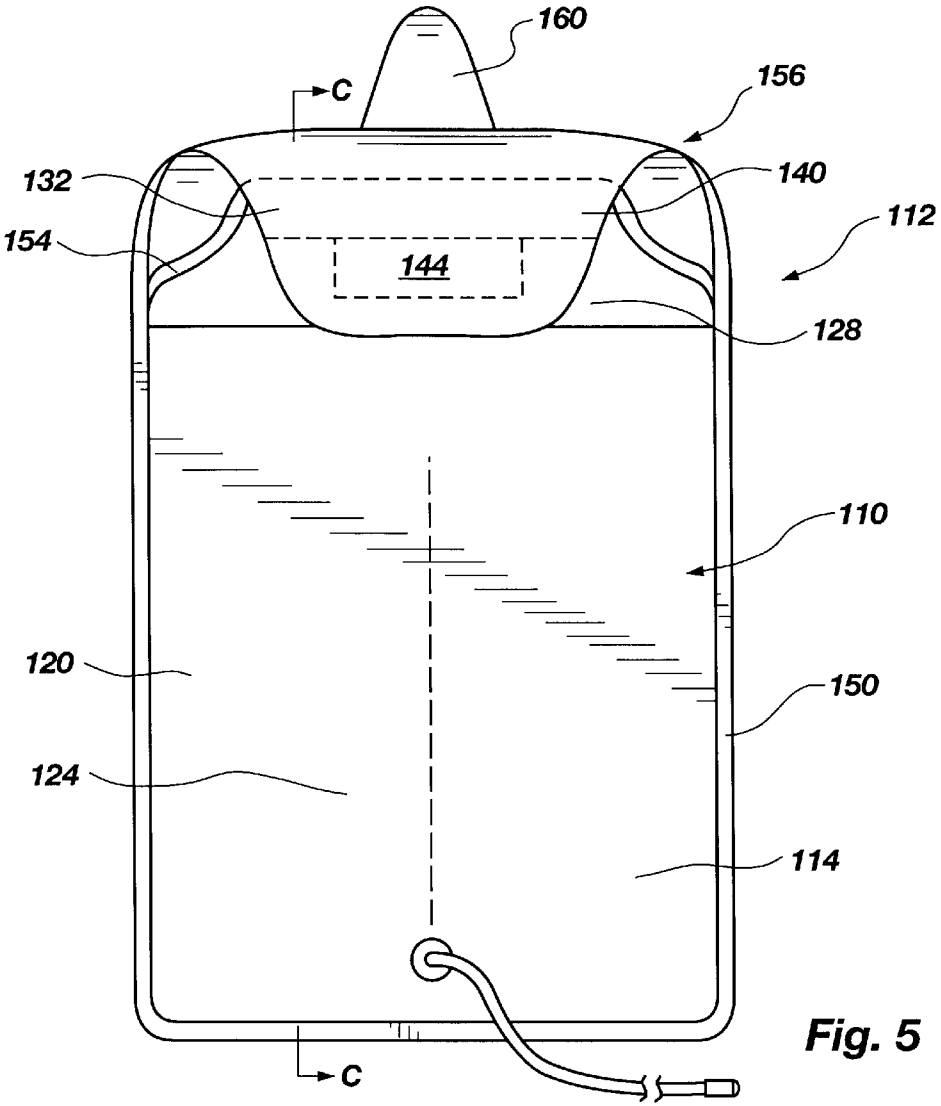
FIG. 5 shows an alternate embodiment of the present invention where the bladder is formed integrally with a support frame.

Turning now to FIG. 5, there is shown an alternate embodiment of the invention which includes a bladder 110 and a support frame, generally indicated at 112. The support frame provides support for the bladder and enables the bladder to be hung upon a support device (not shown) if necessary. Thus, the bladder may be hung from a clip in a backpack, or may be hung from a tree to facilitate showering.

The bladder 110 is substantially the same as that discussed with respect to FIGS. 1 through 4 above. The bladder is formed from first and second sheets 114 and 118 (the second sheet being concealed in FIG. 5). While the embodiment shown uses two separate sheets which are bonded together about their perimeter, the first and second sheets can be formed from a single sheet which is folded to provide two opposing sheet portions which may be selectively sealed to provide a bladder as described herein.

The bladder 110 includes a body portion 120 which defines a containment area for holding liquids. The body portion 120 is sealed round about except for an opening 128 at the top thereof.

A neck portion 132 extends upwardly from the body portion 120 so as to define a conduit leading into the opening 128 in the body portion. The neck portion 132 can be extended into an open position to thereby provide an open conduit into the body portion to facilitate the placement of liquid or other materials into the body portion 120 of the bladder.

As with the prior embodiment, the neck portion 132 also can be rolled toward the body portion 120 into a closed position to prevent the flow of liquid out of the body portion. A fastener means 144, typically in the form of hook and loop fasteners, is disposed on the neck portion 132 to hold the neck portion in the closed position when such is desired.

FIG. 5 also shows the support frame 112. The support frame 112 includes a ribbing 150 which extends around the sides and bottom of the body portion 120 of the bladder 110. The ribbing 150 will typically be sewn to the bladder 110 slightly outside of the bond 154 which is used to seal to two sheets together. The ribbing 150 provides additional support to the bladder 110 and facilitates hanging of the bladder as will be described below.

The ribbing 150 extends upwardly and is attached to a cover means, generally indicated at 156. The cover means 156 is generally formed from a piece of durable fabric, such as cordura, which sufficiently rigid to support the bladder 110. The cover means 156 is disposed in such as manner that it covers the neck portion 132 when the neck portion is rolled in the closed position. The cover means 156 helps to shield the neck portion 132 from dirt and the like. Additionally, the cover means 156 helps to prevent opening of the neck portion 140 by accidental impact of the fastening means 144, such as might occur when the bladder 110 is disposed in a backpack.

The cover means 156 also allows the bladder to be conveniently picked-up and/or hung when desired. A hanging or suspension means, in the form of a small tab 160, is attached to the cover means 156. By pulling upwardly on the tab, the entire bladder 110 and support frame 112 can be lifted or suspended from a tree, etc.

Figure 6:
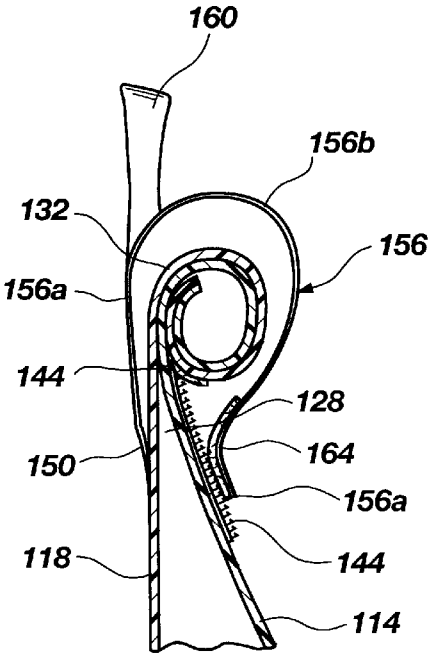
FIG. 6 shows a side cross-sectional view of the bladder of FIG. 5.

FIG. 6 shows a side cross-sectional view of the upper portion of the bladder 110 and cover means 156 shown in FIG. 5. The bladder 110 includes a neck portion 132 which is rolled into a closed position wherein it seals the opening 128 to prevent liquid from passing out of the bladder. The neck portion 132 is held in the closed position by a fastening means in the form of hook and loop fasteners 144, although alternative fasteners such as clips and releasable adhesives could also be used.

Also shown is a cross-sectional view of the cover means 156 which forms part of the support frame 112. The cover means 156 is attached to the ribbing 150 which is attached to the bladder 110 about the perimeter bonded seam 154 (FIG. 5).

As shown in FIG. 6, the cover means has a rear portion 156*a* which is attached to the ribbing 150 and disposed adjacent the second sheet of material 118. A front portion 156*b* extends from the rear portion 156*a* and is sufficiently long to extend over the neck portion 132 when the neck portion is disposed in the rolled, closed position. Preferably, a fastener 164, such as a hook and loop fastener, is disposed adjacent an end 156*c* of the rear portion so as to engage the fastener means 144. While shown disposed substantially above the rolled neck portion 132, it is preferable for the cover means 156 to snugly engage the neck portion when the neck portion is in a rolled position. This helps to reinforce the seal provided by the neck portion and the fastener attached thereto. As the fastener 164 engages the fastener means 144, the cover means is secured over the neck portion 132 and the risk of accidental opening of the neck portion is significantly reduced. Additionally, if the fastener 164 is sufficiently secured to the fastener means 144, the bladder 110 and support frame 112 can be lifted by the tab 160.

Those skilled in the art will appreciate numerous modifications which could be made without departing from the scope and spirit of the present invention. For example, the neck portion discussed above need not taper inwardly from the lateral sides, although such a configuration is preferred.

Thus there is disclosed an improved bladder having an enlarged opening for placing items within the containment area of the bladder. The appended claims are intended to cover the above described invention and modifications thereto which would apparent to those skilled in the art in light of the disclosure.

What is claimed is:

1. A portable bladder for holding liquids, the bladder comprising:

first and second sheets of flexible material disposed adjacent each other and bonded to one another so as to define:

a containment area sealed at a bottom side and lateral sides and not being sealed on a top side, the containment area having an opening; and a neck portion extending from the opening and having an open top end so as to form a conduit into the containment area, the neck portion having a first, open position and a closed position wherein the neck portion is rolled upon itself so as to close the conduit and thereby provide a seal adjacent the top side of the containment area which prevents liquid from flowing out of the containment area through the opening, and wherein at least a portion of the first and second sheets are formed from self-sealing material so as to form a sealing means for sealing the neck portion exclusive of pressure being applied thereto.

2. The bladder according to claim 1, further comprising fastening means attached to at least one of the first and second sheets of material for selectively holding the neck portion in the closed position independent of the sealing means.

3. The bladder according to claim 1, wherein at least one of the first and second sheets of material is formed from polyurethane.

4. The bladder of claim 1, further comprising a baffle disposed between the first and second sheets of material.

5. A portable bladder for holding liquids the bladder comprising:

at least one sheet of flexible material configured such that first and second sheet portions are disposed adjacent one another and bonded to one another so as to define a containment area sealed on a bottom side and lateral sides and not being sealed on a top side so as to provide an opening into the containment area; and a neck portion attached to the at least one sheet of flexible material and disposed to extend from the opening and having an open top end so as to form a conduit into the containment area, the neck portion having a first, open position and a closed position wherein the neck portion is rolled upon itself so as to close the conduit and means for providing a seal adjacent the top side of the containment area which prevents liquid from flowing out of the containment area through the opening independent of application of external pressure to the neck portion, said means for providing a seal comprising a self-sealing material.

6. The bladder of claim 5, wherein the neck portion comprises a material selected from the group consisting of static cling vinyl and polyurethane.

7. The bladder of claim 5, further comprising fastener means for holding the neck portion in a closed position.

8. The bladder of claim 5, wherein the neck portion is tapered so as to narrow as it extends away from the opening.

9. The bladder of claim 5, wherein the bladder further comprises a support frame attached to at least one of the first and second sheets of flexible material.

10. The bladder of claim 9, wherein the support frame comprises a ribbing attached to the lateral sides and the bottom side of at least one of the first and second sheets of flexible material.

11. The bladder of claim 9, wherein the support frame further comprises cover means attached to the bladder and disposed so as to cover the neck portion when the neck portion is in the closed position.

12. The bladder of claim 11, wherein the support frame further comprises a hanging means for suspending the bladder.

13. The bladder of claim 12, wherein the hanging means comprises a tab attached to the cover means.

14. The bladder of claim 5, further comprising a baffle disposed in the containment area.

15. A method for forming a roll top bladder for holding liquids, the method comprising:

(a) selecting at least one sheet of flexible material;

(b) forming the at least one sheet of flexible material into a bladder having a seal lateral sides and a seal bottom side, and an unsealed upper side so as to define an opening;

(c) forming a neck portion which extends from the at least one sheet of flexible material so as to form a conduit into the opening, the neck portion being formed from a self-sealing material so as to form a seal when the neck portion is rolled toward the containment area into a closed position without an external holding mechanism, while allowing access to the containment area when the neck portion is in an open position wherein it is not rolled toward the containment area.

16. The method according to claim 15, wherein the method comprises forming the neck portion from a material selected from the group consisting of static cling vinyl and self-sealing polyurethane.

17. The method according to claim 15, wherein the method comprises forming the neck portion so that it tapers inwardly as it extends from the containment area.

18. The method according to claim 15, wherein the method further comprises selecting a support frame and attaching the support frame to the bladder.

19. The method according to claim 18, wherein the method comprises selecting a support frame having a cover means, and attaching the support frame so that the support frame covers the neck portion when the neck portion is rolled into the closed position.

* * * * *